United States Patent [19]

Wong

[11] Patent Number: 4,678,871

[45] Date of Patent: Jul. 7, 1987

[54] REVERSING SWITCH FOR RECHARGEABLE HAND TOOL

[75] Inventor: Jun G. Wong, Villa Park, Ill.

[73] Assignee: Skil Corporation, Chicago, Ill.

[21] Appl. No.: 757,334

[22] Filed: Jul. 22, 1985

[51] Int. Cl.[4] ..... H01H 19/10; H01H 21/18

[52] U.S. Cl. ..... 200/1 V; 200/6 K; 200/157

[58] Field of Search ..... 30/DIG. 1; 200/1 V, 200/6 R, 157, 339; 310/47, 50; 144/134 D, 136 C; 320/2

[56] References Cited

U.S. PATENT DOCUMENTS

| | | | |
|---|---|---|---|
| 2,807,684 | 9/1957 | Ayers | 200/6 R |
| 2,961,519 | 11/1960 | Sadowsky et al. | 200/6 R |
| 2,979,089 | 4/1961 | Piesker | 30/DIG. 1 |
| 3,089,071 | 5/1963 | Hartwig | 320/2 |
| 3,238,394 | 3/1966 | Cohn | 320/2 |
| 3,691,322 | 9/1972 | Matthews | 200/1 V |
| 3,928,743 | 12/1975 | Ohashi | 200/308 |
| 3,935,909 | 2/1976 | Mabuchi et al. | 310/50 |
| 4,078,589 | 3/1978 | Miller | 310/50 |

FOREIGN PATENT DOCUMENTS

| | | | |
|---|---|---|---|
| 260410 | 8/1963 | Australia | 310/50 |
| 1195078 | 11/1959 | France | 200/6 R |
| 130079 | 10/1980 | Japan | 320/2 |

*Primary Examiner*—Steven L. Stephan
*Assistant Examiner*—W. Morris Worth
*Attorney, Agent, or Firm*—Jones, Day, Reavis & Pogue

[57] ABSTRACT

A reversing switch for use in a rechargeable hand tool, the switch being located between the battery and the electric motor and being in direct contact with both. The switch has an actuator pivotally connected to an insulating mounting support which also holds two transfer terminals, one connected to each of two terminals of the battery, and a contact carrier which is rotatably connected to the support and coupled to the actuator in order to be rotated by the pivoting of the actuator. Pivot contacts are attached to the contact carrier displaced from one another to provide a space for the parallel leads of the electric motor. Pivoting of the actuator reverses the connection of battery terminals to the motor leads and, accordingly, reverses the direction of the electric motor. The transfer terminals have recharging contacts which are accessible through ports in the housing of the hand tool to allow recharging of the battery without removing it from the rest of the tool.

21 Claims, 9 Drawing Figures

REVERSING SWITCH FOR RECHARGEABLE HAND TOOL

BACKGROUND OF THE INVENTION

The invention generally relates to switches for use in hand tools and, more specifically, to reversing switches for use in rechargeable, battery-operated hand tools.

Over the years, hand tools have been automated to provide increased power, versatility and ease of use. Orginally, the power tools were run off standard household voltage which provided adequate power, but required the availability of an outlet for plugging in the cord of the tool. To deal with this drawback, battery-operated tools were developed which did not require standard household current, but did require periodic replacement of the battery power source. More recently, hybrid power tools were developed which run off power supplied by a battery, but which provide a battery which can be periodically recharged using household electric current. Thus, the rechargeable battery-operated hand tool could be used anywhere, even in places without electricity, and also did not need replacement of batteries, as long as the battery was adequately recharged.

Recently, in-line or straight hand-held power tools have been available. Specifically, rechargeable portable battery-operated screwdrivers have been provided which provide forward and reverse motor action. However, these products require special motor leads to interact with the reversing switch and, in some cases, removal of the battery pack or battery portion of the tool to recharge the battery.

Specifically, rechargeable, reversing, battery-operated screwdrivers have been produced by Milwaukee Electric Tool Corporation (No. 6539-1) having a hand-grip portion which swivels between pistol and in-line (straight) positions. The battery of that device must be removed for recharging. The "Daikyo" device is similar, with a two position handle and also requires disassembly of the device for recharging. Amercep, Inc. provides an additional device.

The Milwaukee device utilizes a switch which requires an unusual motor with a first lead being "horseshoe" shaped and a second lead being positioned within the "horseshoe". Two contacts, residing on either side of the second lead, between the "horseshoe" and the second lead, are shifted in one direction or another to contact opposite leads to reverse the direction of the current through the motor and, consequently, the direction of the motor, This switch will not work with a standard electric motor having uniform, parallel leads.

It is an object of the present invention to provide an improved reversing switch for a hand-held power tool.

It is another object to provide a reversing switch which can be used directly with a motor having standard parallel leads.

It is another object of the present invention to provide an improved reversing switch for an in-line power tool, such as a screwdriver.

It is another object of the present invention to provide a reversing switch for a rechargeable power tool, which can be recharged without removing the battery or the battey portion from the remainder of the tool.

It is yet another object to provide an improved, rechargeable, hand-held power tool, preferrably an in-line screwdriver, which can be recharged without removal of a battery or battery portion from the tool, and which can use a motor having parallel leads.

Further and additional objects will become apparent from the following discussion of a preferred embodiment of the invention.

SUMMARY OF THE INVENTION

In accordance with the invention, a rechargeable power tool has an external housing which holds, in a straight or in-line orientation, a rechargeable battery having positive and negative terminals, a switch, a motor having parallel motor leads, planetary gearing connected to the drive-shaft of the motor, and a bit or tool grasping unit which is turned by the planetary gearing. The switch sits between the battery and the motor and has a rocking button or switch actuator accessible through one side of the housing and recharging contacts accessible through parts on the opposite side. The switch provides the simple connection between the battery and the motor, allowing a reversing of the current direction and, consequently, the motor direction, and also provides the ability to recharge the battery without removing the battery or the battery portion of the tool.

The switch has an actuator pivotally connected to an insulating mounting support which also holds two transfer terminals, one connected to each of two terminals of the battery. and a contact carrier which is rotatably connected to the support and coupled to the actuator in order to be rotated by the pivoting of the actuator. The transfer terminals have recharging contacts which are accessible through parts in the housing of the hand tool to allow recharging of the battery without removing it from the rest of the tool. Pivot contacts are attached to the contact carrier displaced from one another to provide a space for the parallel-oriented leads of the electric motor. Pivoting of the actuator thereby reverses the connection of the battery terminals to the motor leads and, accordingly, reverses the direction of the electric motor.

DETAILED DESCRIPTION OF THE PREFERRED EMBODIMENT

Figure 1:
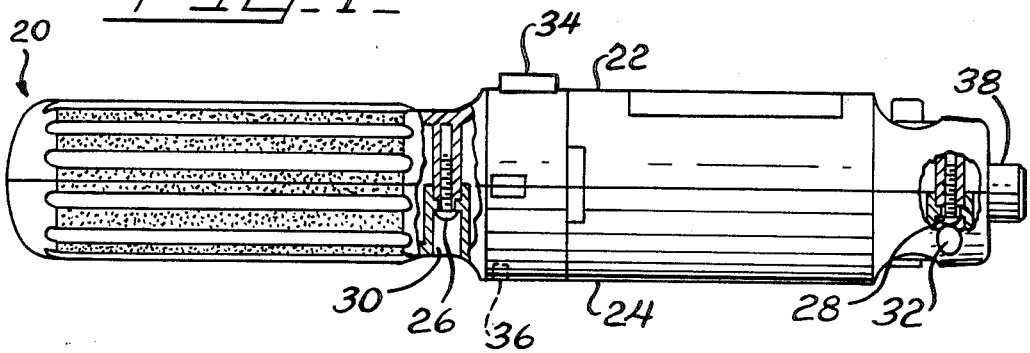
FIG. 1 is a side plan view of the preferred embodiment with two portions cut away to reveal the interior.

The present invention may be better understood by detailed reference to the drawings of the preferred embodiment. Referring first to FIG. 1, the preferred embodiment is generally designated 20. The tool is externally comprised of upper housing half 22 and lower housing half 24. The housing halves 22, 24 are held together by screws 26 and 28 (shown through sectioned portions of drawing) which slide through passageways 30 and 32, respectively, to snuggly grasp the lower housing half 24 to the upper housing half 22. Screw 28 is actually off-center and an additional screw (not shown) on the other side of the tool provides a similar function.

The housing contains openings at various points to provide access to the workings of the device. A rocking button or switch actuator 34 protrudes through a space in the housing to allowing forward, off and reverse drive options. Recharging access ports 36 (one shown in dotted lines through housing) allows access to recharging contacts without opening up the housing or removing the battery or the battery portion of the tool. Of course, an opening in the front of the housing allows the tool grasping unit 38 to protrude from the housing.

Figure 2:
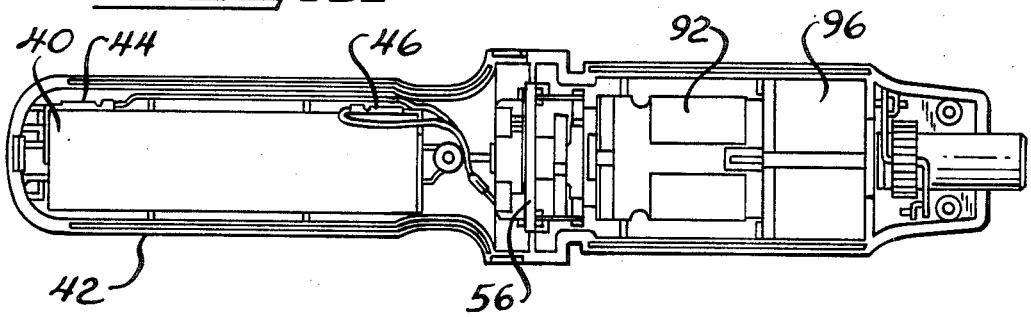
FIG. 2 is a bottom plan view of the preferred embodiment with lower portion of the housing removed.
Figure 3:
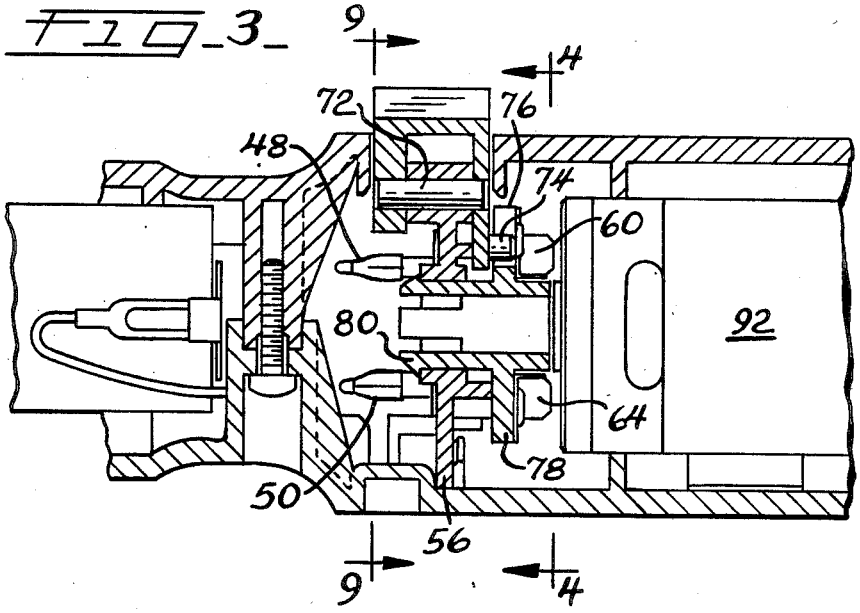
FIG. 3 is a cross-sectional view of the switch section of the preferred embodiment.
Figure 8:
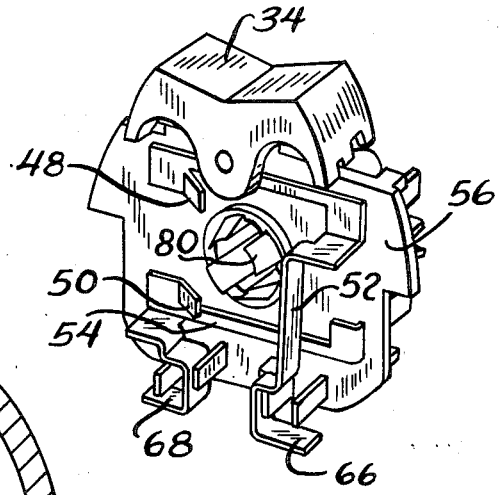
FIG. 8 is a perspective view of the battery-side of the switch.
Figure 9:
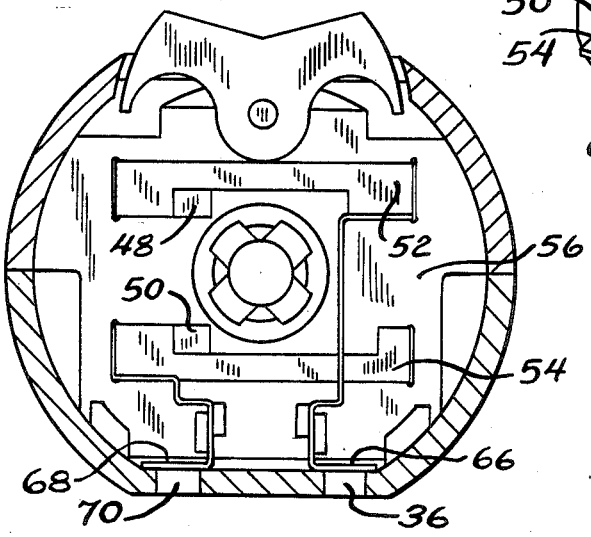
FIG. 9 is a cross-sectional view of the switch taken at section line 9—9 shown in FIG. 3.

Now, with specific reference to FIG. 2 and FIG. 3, the internal workings of the device will be described. Rechargeable battery 40 is contained in the housing, inside the battery-portion or handle 42 of the device. The battery has positive and a negative terminal 44, 46, which are connected to the battery posts 48, 50 of the upper transfer terminal 52 and the lower transfer terminal 54 (now see additional FIGS. 7–9). The upper and lower transfer terminals are made of an electrically conductive material, preferrably brass, and are attached to an electrically insulating mounting support 56, and pass therethrough to form first and second upper forward leads 58, 60 by the upper transfer terminal, and first and second lower forward leads 62, 64 by the lower transfer terminal. The upper and lower transfer terminals 52, 54 also form recharging contacts 66, 68 which are accessible through the bottom housing 24 through access ports 36 and 70.

The switch actuator 34 is pivotally attached to the mounting support by a pivot 72 passing through the mounting support 56. The actuator is formed into an actuator pin 74 which is displaced from the pivot 72 so that it pivots about the pivot 72 when the actuator 34 is rocked in either direction. The pin 74 fits into a groove 76 in the contact carrier 78 which is rotatably connected to the mounting support 56 by insertion of male portion 80 into a hold in the mounting support 56. The contact carrier is attached to an upper pivot contact 82 and a lower pivot contact 84 by buttons 86 passing through the pivot contacts. The contact carrier is made of an electrically insulating material, such as ABS, as are the buttons.

Figure 7:
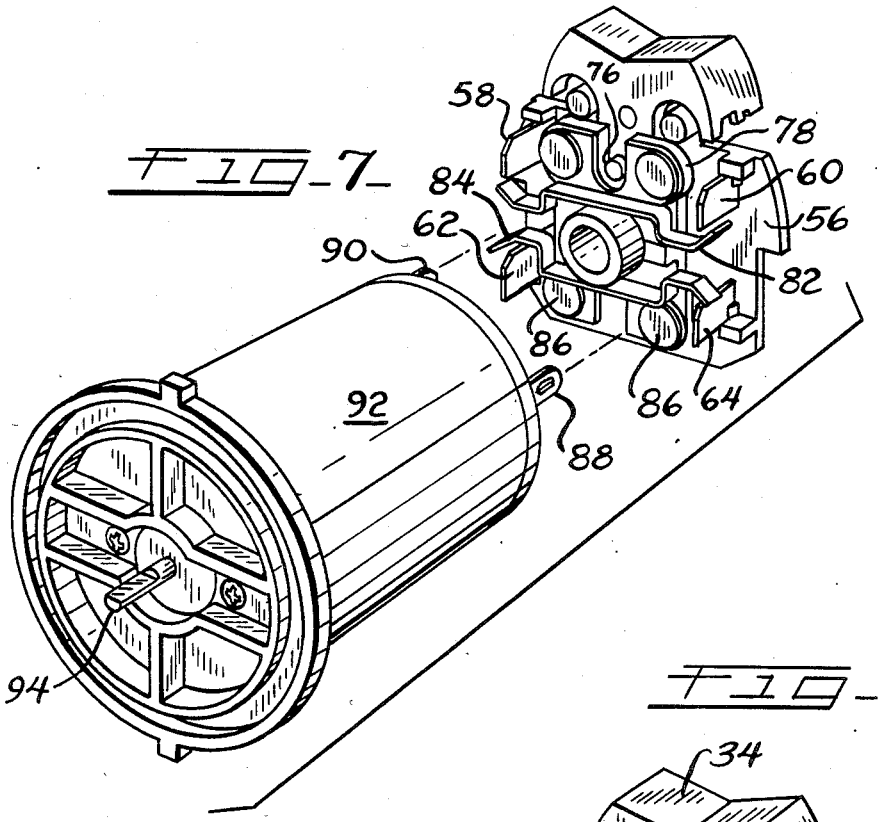
FIG. 7 is a perspective view of the motor-side of the switch and the motor, showing an exploded view of the orientation of the motor to the switch.

Pivot contacts 82, 84 are displaced to define a space into which the first and second leads 88, 90 of the electric motor 92 may be located, as shown in FIG. 7, which is located in the motor portion of the housing. The pivot contacts are made of an electrically conductive material, preferrably bronze. The pivot contacts 82, 84 are oriented to pivot with the rotation of the contact carrier 78 and communicate between various leads and to alternatively reverse the direction of the current (electromotive force) from the battery 40 and, consequently, the direction of the spin of the electric motor 92.

Figure 4:
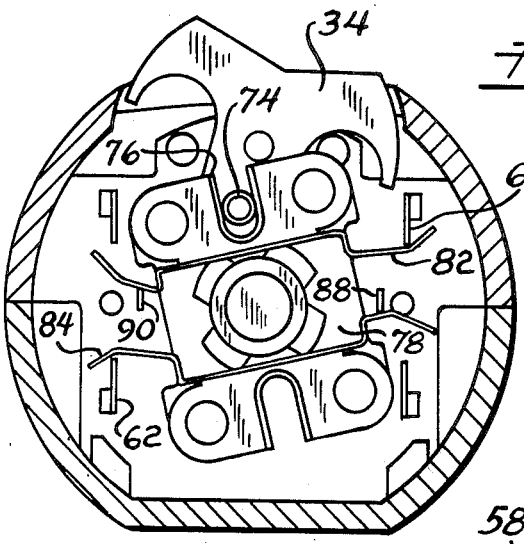
FIG. 4 is a cross-sectional view taken through section line 4—4 indicated in FIG. 3, showing the switch in an on position.

The operations of the switch are best discussed with reference to FIGS. 4–6. FIG. 4 shows the switch actuator in a first on position, we will call this the reverse position, but for all practical purposes it could just as well designate the reverse direction of spin of the motor 92. The actuator 34 in this position rotates the contact carrier 78 so that upper pivot contact 82 communicates between second forward lead 60 and second motor lead 90, while the lower pivot contact 84 communicates between first lower forward 62 and first motor lead 88. Because the first lower forward lead is electrically conductive through the lower transfer terminal 54 to one terminal of the battery and the second upper forward lead is electrically conductive through the upper transfer terminal 52 to the other terminal of the battery, a voltage or electromotive force is created across the two motor leads 88, 90 which activates the motor to turn the drive shaft 94.

Figure 5:
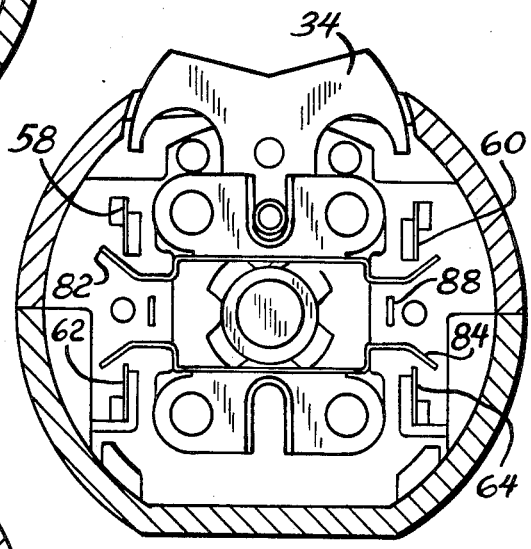
FIG. 5 is the same view as FIG. 4, showing the switch in the off position.

The pivoting of the actuator 34 to an intermediate position (against a spring, not shown) rotates the contact carrier to an intermediate position, as shown in FIG. 5. In this position, the pivot contacts do not communicate with the leads and no electricity travels to the motor. This is the off position.

Figure 6:
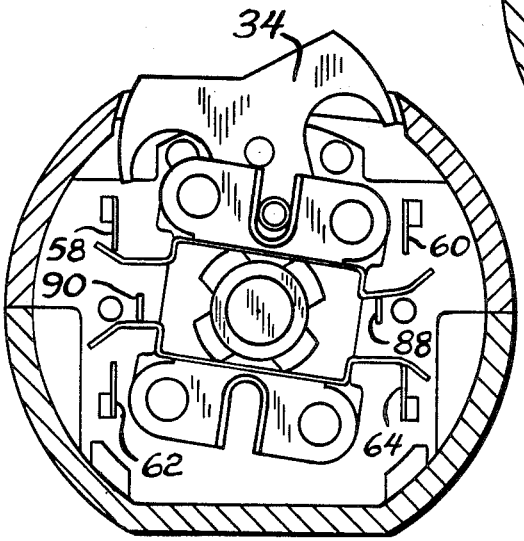
FIG. 6 is the same view as FIG. 4 and FIG. 5, showing the switch in a second on position, reversing the direction of the current from that shown in FIG. 4.

The continued pivoting of the actuator 34 will bring it to the position shown in FIG. 6. In this position, the contact carrier 78 orients the upper pivot contact 82 to communicate between the first upper forward lead 58 and the first motor lead 88, while the lower pivot contact 84 communicates between the second lower forward lead 64 and motor lead 90. Therefore, as before, one motor lead 88 is electrically conductive to one battery terminal through the upper transfer terminal while the other motor lead 90 is conductive to the other battery terminal through the lower transfer terminal causing the voltage across the leads 88, 90 to drive the motor 92. However, the position in FIG. 6, as compared to the position in FIG. 4, connects the opposite battery terminals to each motor lead. Therefore, the current will run in the opposite direction and turn the motor 92 in the opposite direction. This switch position is in the forward of that shown in FIG. 4.

The spinning of drive shaft 94 by motor 92 will, in turn, drive the planetary gearing 96 located near the head of the device. The planetary gearing 96 increases the torque and reduces the rotational speed of the motor 92 before driving the tool grasping unit 38. Of course, the reversal of the direction of spin of the drive shaft will reverse the direction of spin of the tool grasping unit 38 and the associated tool (not shown), which may be, preferrably, a screwdriver head, but also may be a drill bit, sanding disc holder, mixing implement or any other appropriate tool known in the art which is rotated during use.

The materials to be used in constructing the device are known generally in the art. The pivot contacts are preferrably nickel plated phosphor bronze, but may be copper or any other conductive material. The electric motor is preferrably a D.C. motor having no load speed of 10,900 RPM at 2.49 volts, with rated load 2.5 ounces-inch at 15 amps, 2.20 volts. The motor should operate in a range of −20° C. to 40° C. and be able to be stored in a range of −40° C. to 50° C. without damage. The actuator is preferrably made of ABS or nylon, as is the mounting support. The transfer terminals are preferrably spring tempered, tinned brass, but may be made from other conductive materials such as copper.

The rechargeable battery may be any appropriate battery known in the art. It is recharged by placing the device in a recharging holder (not shown) which contacts the appropriate recharging contacts 66, 68 through the access ports 36, 70 (see FIG. 9) which are electrically conductive to the upper transfer terminal 52 and lower transfer terminal 54 which are further conductive to a different battery terminal to provide recharging. This is accomplished without removing the battery from the housing or removing a battery containing portion of the device from the rest of the device. Therefore, the tool can be used when needed, and returned to its recharging holder when not in use. There is no need to take apart and put together the device between uses.

From the above description, it will be apparent that there is thus provided a switch and hand tool with the advantages discussed, but which is clearly subject to variation and modification without departing from the invention contemplated herein. The scope of the invention, therefore, is not to be limited to the specific embodiment disclosed above, but is to be judged by the legitimate and valid breadth of the claims appended hereto.

I claim:

1. A rechargeable hand tool having a housing with access ports, a rechargeable battery, an electric motor having parallel motor leads and a reversing switch between the motor and the battery, the switch comprising:

a stationary mounting support located in the housing;

a switch actuator pivotally mounted to the stationary mounting support;

an upper transfer terminal forming an integrally formed structure comprising a first upper forward post, a second upper forward post, and a first recharging post, the upper transfer terminal being connectable to a second battery terminal;

a lower transfer terminal forming a second integrally formed structure comprising a first lower forward post, a second lower forward post, and a second recharging post, the lower transfer terminal being connectable to a first battery terminal opposite the second battery terminal;

a contact carrier rotatably mounted on the stationary mounting support so that pivoting the switch actuator rotates the contact carrier;

upper and lower pivot contacts attached to the contact carrier, the pivot contacts being electrically insulated from one another;

wherein the pivot contacts are oriented to define a space in which the motor leads are situated so the upper pivot contact connects one upper forward post with a first motor lead and the lower pivot contact connects one lower forward post with a second motor lead when the actuator is in a first position, and when the actuator is in a second position the upper pivot contact connects one of the upper forward posts with the second motor lead and the lower pivot contact connects one of the lower forward posts with the first motor lead; and wherein the first and second recharging posts are disposed near the access ports and application of an electromotive force between the recharging posts would supply a charge to the battery;

whereby a battery in contact with the transfer terminals would drive the motor in one direction when the actuator is in a first position and drive the motor in an opposite direction when the actuator is in a second position and whereby the battery can be recharged by easy access to the recharging posts and without removing the battery.

2. The reversing switch of claim 1 wherein the switch actuator has an actuator pin displaced from the actuator's pivotal connection to the stationary mounting support, the actuator pin associating with the contact carrier whereby pivoting of actuator in one direction results in rotation of the contact carrier in the opposite direction.

3. The reversing switch of claim 1 wherein the upper transfer terminal is mounted on the stationary mounting support with upper forward posts protruding through the mounting support.

4. The reversing switch of claims 1 or 3 wherein the lower transfer terminal is mounted on the stationary mounting support with lower forward posts protruding through the mounting support.

5. The reversing switch of claim 1 wherein the pivot contacts are oriented to contact neither forward posts nor motor leads when the actuator is in a position intermediate the first position and the second position.

6. The reversing switch of claim 1 wherein the stationary mounting support is made of an insulating material.

7. The reversing switch of claim 1 wherein the contact carrier is made of an insulating material, and wherein the upper pivot contact is attached to the top portion of the contact carrier and the lower pivot contact is attached to the bottom portion of the contact carrier.

8. The reversing switch of claim 1 wherein the switch actuator is pivotally mounted to the stationary mounting support by an actuator pin passing through the mounting support.

9. A switch for use in a rechargeable, battery hand tool, the hand tool having a housing containing a rechargeable battery, an electric motor having parallel first and second motor leads, the switch comprising:

a mounting support;

a switch actuator pivotally mounted to the mounting support;

an upper transfer terminal comprising a first integrally formed recharging contact, the upper transfer terminal being mounted on the mounting support and having a portion connectable to a second terminal of a battery;

a lower transfer terminal comprising a second integrally formed recharging contact, the lower transfer terminal being mounted on the mounting support connected to a first terminal of a battery;

movable contact means for connecting the upper transfer terminal to the first motor lead and the lower transfer terminal to the second motor lead when the actuator is in a first position, and for connecting the upper transfer terminal to the second motor lead and the lower transfer terminal to the first motor lead when the actuator is in a second position, wherein the recharging contacts are accessible through apertures in the housing and application of an electromotive force between the recharging contacts will recharge the battery;

whereby the battery may be recharged without removing it from the hand tool.

10. The switch of claim 9, wherein the conduit means comprises:

a contact carrier rotatably mounted on the mounting support and coupled with the switch actuator such that pivoting the actuator rotates the contact carrier;

upper and lower pivot contacts attached to the contact carrier, the pivot contacts being electrically insulated from one another;

wherein the upper pivot contact communicates between the upper transfer terminal and the first motor lead and the lower pivot contact communicates between the lower transfer terminal and the second motor lead when the actuator is in a first position, and the upper pivot contact communicates between the upper transfer terminal and the second motor lead and the lower pivot contact communicates between the lower transfer terminal and the first motor lead when the actuator is in a second position.

11. The switch of claim 10 wherein the upper and lower transfer terminals each further comprise integral forward posts which communicate with the pivot contacts.

12. The switch of claim 11 wherein the switch actuator has a pin which associates with a groove in the contact carrier to provide said coupling.

13. The switch of claims 9 or 10 wherein the switch actuator has a third position in which the contact means fail to communicate between the transfer terminals and the motor leads.

14. The switch of claim 10 wherein said pivot contacts define a space between them in which the motor leads are located.

15. A rechargeable, battery-operated hand tool comprising:

a housing having a handle portion and a motor portion;

a rechargeable battery contained in the handle portion of the housing, the battery having a positive terminal and a negative terminal;

an electric motor contained in the motor portion of the housing, the motor having two motor leads; and a switch contained in the housing, located between the battery and the motor, the switch comprising a mounting support, an actuator connected to the mounting support, two transfer terminals, one transfer terminal having an integral portion adapted for direct communication with the positive battery terminal and a second transfer terminal having an integral portion adapted for direct communication with the negative battery terminal, each transfer terminal also having an integral recharging contact disposed near an access port in the housing, and the switch also comprising movable contact means for communicating between the transfer terminals and the motor leads when the actuator is placed in an "on" position;

whereby the battery can be recharged through the recharging contacts without opening the housing or removing the battery portion of the housing when said actuator is placed in an "OFF"0 position.

16. The hand tool of claim 15 further comprising:

planetary gearing contained in the housing, the gearing communicating between the electric motor and a tool unit;

whereby the torque on the tool unit is increased over the torque generated by the electric motor.

17. The hand tool of claim 16 wherein the tool unit is a screwdriver head.

18. The hand tool of claim 15 wherein the movable contact means comprises:

a contact carrier rotatably mounted on the mounting support; and upper and lower pivot contacts attached to the contact carrier, the upper pivot contact communicating between the first transfer terminal and a first motor lead and the lower pivot contact communicating between the second transfer terminal and the second motor lead when the actuator is in a first position, while when the actuator is in a second position the upper pivot contact communicates between the first transfer terminal and the second motor contact and the lower pivot contact communicates between the second transfer terminal and the first motor contact;

whereby the positive and negative battery terminals communicate with opposite motor leads when the actuator is in the first position as compared with when the actuator is in the second position, and the direction of the motor runs in an opposite direction when the actuator is in the first position as compared to when the actuator is in the second position.

19. The hand tool of claim 18 wherein the actuator has a third position in which the pivot contacts do not communicate between the transfer terminals and the motor leads, said third position being intermediate of the first and the second positions of the actuator.

20. The hand tool of claim 18 wherein:

the actuator is pivotally connected to the mounting support and has a pin, and wherein the contact carrier has a groove in coupled relation to the pin of the actuator such that pivoting of the actuator rotates the contact carrier; and wherein pivoting the actuator causes communication between the transfer terminals and motor leads.

21. The hand tool of claim 20 wherein:

the motor leads are parallel to one another and between the pivot contacts.

* * * * *